US006332585B1

(12) United States Patent
Schwede

(10) Patent No.: US 6,332,585 B1
(45) Date of Patent: Dec. 25, 2001

(54) APPARATUS FOR THE INTERMEDIATE STORAGE OF A STRAP TO BE SUPPLIED AND DELIVERED DISCONTINUOUSLY

(75) Inventor: Roland Schwede, Goldkronach (DE)

(73) Assignee: SMB Schwede Maschinenbau GmbH, Goldkronach (DE)

( * ) Notice: Subject to any disclaimer, the term of this patent is extended or adjusted under 35 U.S.C. 154(b) by 0 days.

(21) Appl. No.: 09/481,414

(22) Filed: Jan. 12, 2000

(30) Foreign Application Priority Data

Jan. 23, 1999 (DE) ..... 199 02 618

(51) Int. Cl.[7] ..... B65H 51/30; B65H 23/18; B65B 13/22

(52) U.S. Cl. ..... 242/366.1; 242/564.4; 242/417.2; 242/418.1; 226/118.4; 100/32

(58) Field of Search ..... 242/364, 366.1, 242/564.1, 417.2, 418.1, 615.21; 226/43, 118.4; 100/26, 32

(56) References Cited

U.S. PATENT DOCUMENTS 3,951,322 * 4/1976 Giros ..... 242/364 X
4,026,450 * 5/1977 Giros ..... 226/118.4 X
4,120,239 * 10/1978 Pasic et al. ..... 100/26
4,343,422 * 8/1982 Dabringhaus et al. ..... 242/615.21 X
4,589,605 * 5/1986 Orii ..... 242/564.4 X
4,605,178 * 8/1986 Bartzick et al. ..... 100/26 X
5,236,329 * 8/1993 Sylvester ..... 100/32 X
5,366,131 * 11/1994 Hofa et al. ..... 242/417.2 X
5,651,306 * 7/1997 Hoshino ..... 100/26

FOREIGN PATENT DOCUMENTS 2935894 11/1980 (DE) .
0139088 4/1988 (EP) .
303-129 A * 2/1989 (EP) ..... 100/26

* cited by examiner

*Primary Examiner*—Michael R. Mansen
(74) *Attorney, Agent, or Firm*—Browdy and Neimark

(57) ABSTRACT

An apparatus for the intermediate storage of a strap to be supplied and delivered discontinuously in a machine is provided with a supply arrangement for the strap; a storage drum, which is disposed downstream thereof and which comprises an inlet for the strap, an ensuing helical storage channel for the storage of the strap, the radial extension of which exceeds its axial extension, which corresponds to the width of the strap, as well as an outlet, which adjoins the storage channel; and a discharge arrangement for the strap, which is disposed downstream of the storage drum.

7 Claims, 2 Drawing Sheets

APPARATUS FOR THE INTERMEDIATE STORAGE OF A STRAP TO BE SUPPLIED AND DELIVERED DISCONTINUOUSLY

BACKGROUND OF THE INVENTION

1. Field of the Invention

The invention relates to an apparatus for the intermediate storage of a strap to be supplied and delivered discontinuously in a machine, in particular for a looping strap in a packaging machine.

2. Background Art

Intermediate stores of the generic type are needed primarily—but not exclusively—in today's packaging and looping machines, where a strap is taken off a comparatively bulky supply coil on the one hand and inserted into the packaging machine at a very high speed of as many as several meters per second on the other hand. Due to this high speed, the strap cannot be taken directly off the coil since this would imply an acceleration of the supply coil that cannot be put into practice accompanied with virtually non-transferable driving forces to act on the strap.

Another problem in particular with looping machines resides in the fact that the strap is slung as a loose noose from a strap supply around the product stack to be looped. The leading end of the strap is then fixed in the looping machine and the noose is tightened. The section of the strap thus pulled back must be kept adequately so that any trouble in the operation of the machine for instance by an entwined or entangled strap be avoided. To this end, there must be the possibility of pushing or pulling the strap back preferably into the intermediate store.

For these reasons intermediate stores are used, in which the strap is kept in a more or less loose and regular arrangement. One type of such an intermediate store can be seen for example in DE-PS 29 35 894, where the packaging strap is stored in freely meandering loops one above the other. The drawback resides in that the strap curves by a very small radius at the summits of the loops in particular when the store is densely packed. When the strap is kept in the intermediate store for a prolonged time—for instance in the case of breaks in the operation of the packaging machine—this curving engages itself on the strap, which may lead to problems in the subsequent handling of the strap in the machine.

To avoid this drawback, EP 0 139 088 B1 proposes an intermediate store consisting of a flat drum in the form of a cylindrical disk in which the packaging strap is coiled, spiraling loosely. Supply of the strap takes place from the side to the innermost turn at a very acute angle relative to the plane of the drum, delivery takes place starting from the outermost turn of the coil via a gap in the peripheral outer wall of the drum.

The known prior art has the drawback of the comparatively complicated guidance of the strap towards the coil for the strap to approach the innermost turn. Since the turns of the packaging strap lie freely one above the other, the individual layers of the coil of strap may interact, which may give rise to problems in particular in the case of a high level of filling of the store. This applies especially to the specific application in a looping machine, where the strap, when inserted into the strap guiding frame, must be pulled back during the looping job and pushed back into the intermediate store also from the delivery side.

SUMMARY OF THE INVENTION

It is an object of the invention to embody an apparatus for the intermediate storage of a strap to be supplied and delivered discontinuously in a machine in such a way that a sufficient storage capacity and a constructionally simple design are accompanied with troublefree and reliable supply, delivery and even backward insertion of the strap.

This object is attained by the intermediate storage apparatus according to the invention, which is provided with a supply arrangement for the strap, an ensuing storage drum with a helical storage channel for the storage of the strap and a discharge arrangement for the strap disposed downstream of the storage drum.

The gist of the invention resides in the helical storage channel, the radial extension of which exceeds its axial extension which corresponds to the width of the strap.

As a result of this design of the storage drum, the strap to be stored moves along the storage channel without overlapping or piling up. Since the storage channel possesses a great radial extension, the strap can deposit at varying diameters of its individual turns in the helical storage channel, which helps realize the buffer action necessary for the discontinuous and asynchronous supply and delivery of packaging strap. This will become apparent from the description of the exemplary embodiment, to which reference is made.

Owing to the helical storage channel, any packaging strap that has already been pulled off can be pushed back into the storage drum by the aid of the discharge arrangement activated in the opposite sense, which is of advantage in particular with a view to the application of the intermediate storage arrangement in a looping machine. It is further worth mentioning that the storage drum as such does without any movable parts for strap guidance etc., which ensures a very reliable and troublefree operation accompanied with a long service life and low maintenance requirements. Provision can only be made for a corresponding touch contact device that probes the level to which the storage drum is filled.

Advantageous developments of the intermediate storage apparatus will become apparent from the ensuing description of an exemplary embodiment, taken in conjunction with the drawing.

DESCRIPTION OF THE PREFERRED EMBODIMENT

Figure 1:
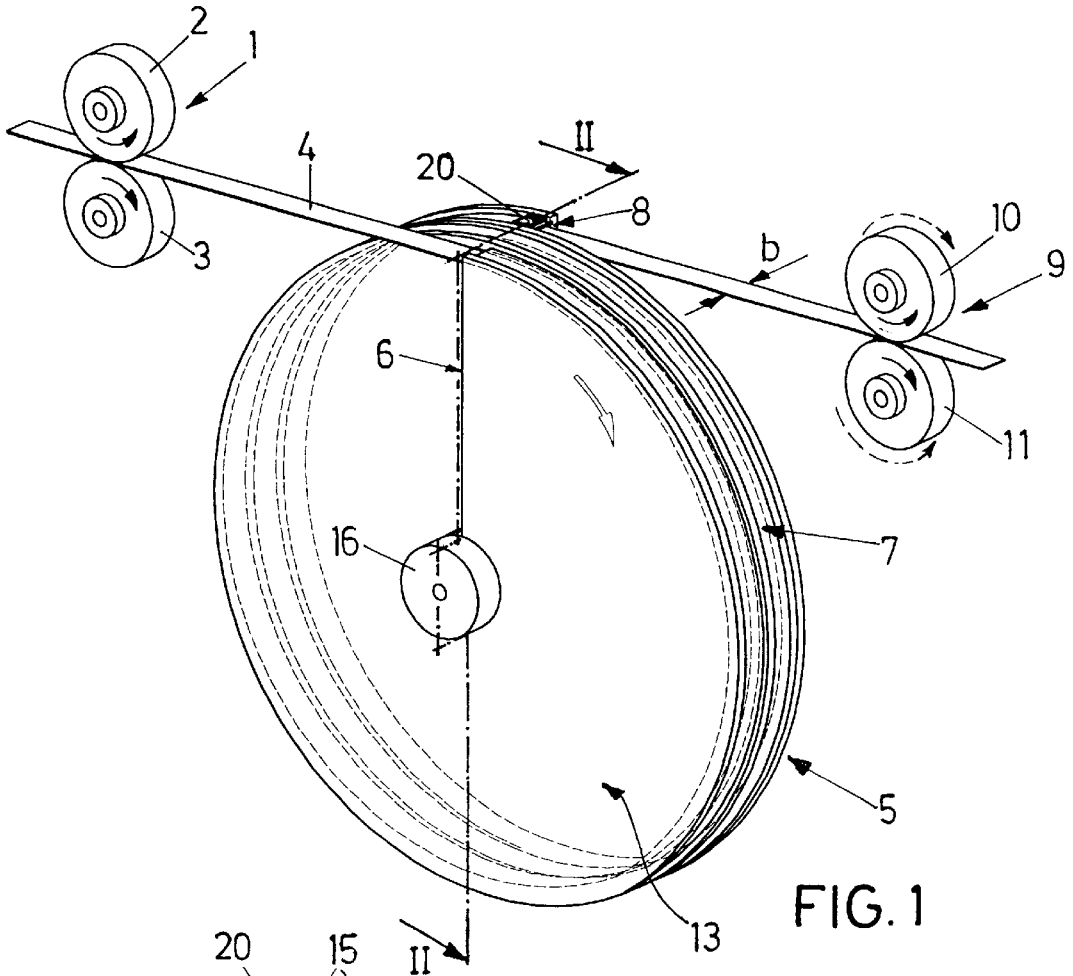
FIG. 1 is a diagrammatic perspective view of an intermediate storage apparatus with maximum storage contents.

As seen in the drawing, the intermediate storage apparatus comprises a supply arrangement in the form of a first pair of drive rollers 1, the rollers 2, 3 of which are driven in an opposite direction. The looping strap 4 is pulled through between the two contacting rollers 2, 3; it is taken off a supply coil (not shown) by the aid of the pair of drive rollers 1 and fed to a subsequent storage drum 5. The storage drum 5 comprises an inlet 6, which is turned toward the pair of drive rollers 1, an adjoining helical storage channel 7 and an outlet 8 located on the storage channel 7. This is where the looping strap 4 emerges, moving toward a discharge arrangement in the form of another pair of drive rollers 9, which is disposed downstream of the storage drum 5 and the rollers 10, 11 of which are again driven in an opposite direction—as roughly outlined by arrows that indicate the direction of rotation. By the aid of the pair of drive rollers 9 seizing the strap 4, the looping strap 4 can be inserted into a looping machine at a high speed of several meters per second until a loose noose is placed around the stack of products to be looped. Then the leading end of the strap is stopped and the pair of drive rollers 9 is driven in the opposite direction—as roughly outlined by dashed arrows indicating the direction of rotation—so that the looping strap 4 is pulled backward and returned again into the storage drums.

The precise design and functioning of the storage drum 5 is explained as follows:

The attached drawing illustrates the helical storage channel 7 as a flight having three complete convolutions, the side walls 12 of the storage channel 7 being formed by a flange part 13 that extends in the shape of an Archimedean screw. Radially outwards, the storage channel 7 is defined by a helical guide surface 14, which is formed by an inherently stable strip of material 15, which is placed between the side walls 12. Radially inwards, the storage channel 7 is defined by a substantially cylindrical core member 16, into the casing wall 17 of which is worked a receiving groove 18 of helical extension. This is where the flange part 13 takes hold by its radially inward edge 19.

Figure 2:
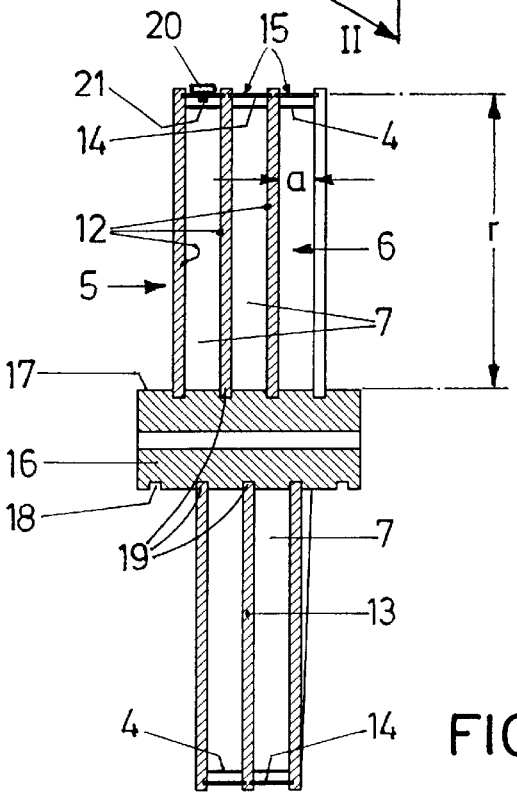
FIG. 2 is an axial section of the intermediate storage apparatus on the section line II—II in FIG. 1.
Figure 4:
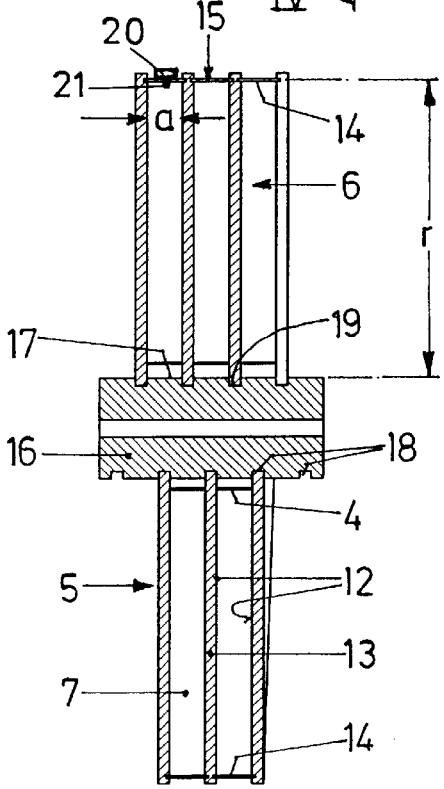
FIG. 4 is a section of the intermediate storage apparatus on the line IV—IV of FIG. 3.

As especially evident from FIGS. 2 and 4, the radial extension r of the helical storage channel 7 substantially exceeds the axial extension a between two side walls 12 that face each other, the axial extension a corresponding to the width b of the strap. The minimum ratio is in the amount of 5.

As for the functioning of the intermediate storage apparatus according to FIGS. 1 to 4, it can be said that, as a preparatory measure, the looping strap 4 is introduced manually via the pair of drive rollers 1 into the storage channel 7 of the storage drum 5 and pushed on so that the looping strap 4 slides along the guide surface 14, which defines the storage channels 7 externally, and emerges from the outlet 8 after having passed through three convolutions. From the outlet 8 it is guided to the pair of drive rollers 9 and into the looping machine (not shown). In the condition seen in FIGS. 1 and 2, the maximum length of strap is accommodated in the storage channel 7.

Figure 3:
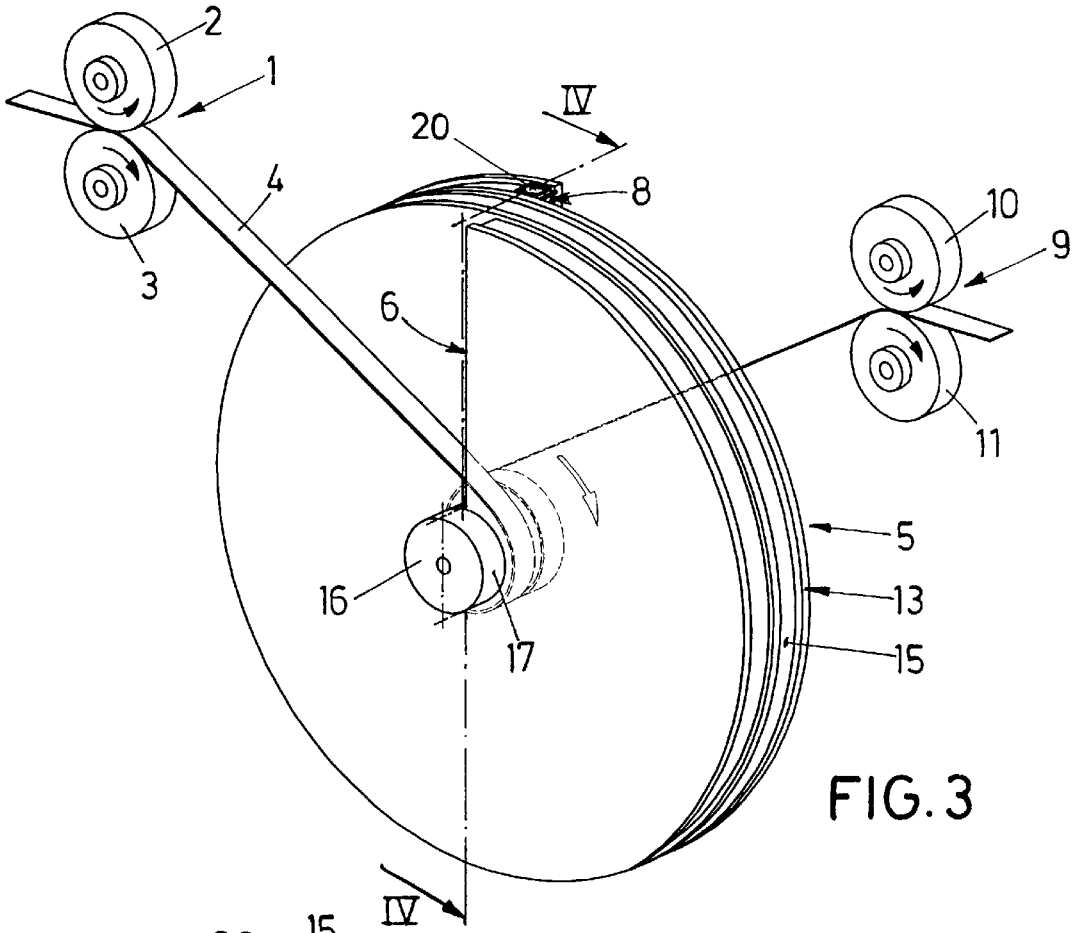
FIG. 3 is a section analogous to FIG. 1 with minimum storage contents.

If strap is to be inserted from the storage drum 5 into the looping machine, then only the pair of drive rollers 9 has to be activated, pulling a certain length of the looping strap out of the storage drum 5. Owing to the radial extension of the storage channel, the looping strap 4 can tighten in the storage drum 5. It is possible to pull out strap without supply via the pair of drive rollers 1, the maximum being reached when the turns of the strap have tightened around the core member 16 in the storage channel 7, as seen in FIGS. 3 and 4. The maximally possible length of strap stored is defined by the difference between the circumferential lengths of the guide surface 14 and the core member 16 of the storage channel 7.

For the supply of strap, the pair of drive rollers 1 is activated, a slow, but regular pull-off motion being desirable for taking the strap off a big supply coil. The looping strap 4 moves virtually continuously into the storage channel 7 via the inlet 6, which, like the outlet 8, has the shape of an elongated rectangle in a frontal view (FIGS. 2 and 4). Regardless of this, looping strap 4 can be pulled out discontinuously and/or asynchronously via the outlet 8 and it can be pushed back again into the storage drum via the outlet 8. The turns of strap 4 in the storage channel 7 tighten when strap is pulled out, they loosen when strap is pushed back. Figuratively speaking, the turns of strap stored in the storage channel 7 breathe.

This behavior of the strap 4 can be used for detection of the level to which the storage drum 5 is filled. To this end, use is made of a micro touch contact 20 which is placed before the outlet 8 externally on the circumference of the storage channel 7 and the probe 21 of which passes through the strip of material 15 inwards into the storage channel 7. The response of the robe is selected such that the strap passing by normally will not be sufficient to actuate the touch contact 20. But as soon as the maximum storage capacity is reached, i.e. as soon as the strap bears by its entire length against the inside of the circumference of the drum formed by the strip of material 15, any further insertion of strap 4 will lead to a force which acts radially outwards, operating the touch contact 21 and thus signaling that the store is completely filled. A corresponding signal can be used by the control system of the looping or packaging machine for stopping for example the pair of drive rollers 1.

Attention is drawn to the fact that devices for the guidance of the looping strap 4 are provided between the pairs of drive rollers 1, 9 on the one hand and the storage drum 5 on the other; these devices are not shown for reasons of clarity.

What is claimed is:

1. An apparatus for an intermediate storage of a strap to be supplied and delivered discontinuously in a machine, in particular for a looping strap in a packaging machine, comprising:

a supply arrangement (1) for the strap (4);

a storage drum (5), which is disposed downstream thereof and which comprises:

an inlet (6) for the strap (4), an ensuing helical storage channel (7) for the storage of the strap (4), a radial extension (r) of which exceeds its axial extension (a), which corresponds to the width (b) of the strap (4), as well as an outlet (8), which adjoins the storage channel (7); and a discharge arrangement for the strap (4), which is disposed downstream of the storage drum (5).

2. An apparatus according to claim 1, wherein the storage channel (7) is defined radially outwards by a helically encircling guide surface (14) for the strap (4).

3. An apparatus according to claim 1, wherein the storage channel (7) is defined radially inwards by a core member (16).

4. An apparatus according to claim 1, wherein side walls (12) of the storage channel (7) are formed by a flange part (13), which extends in a shape of an Archimedean screw.

5. An apparatus according to claim 1, wherein the ratio that the radial extension of the storage channel (7) bears to the axial extension thereof amounts to at least 5.

6. An apparatus according to claim 1, wherein the storage drum (5) is provided with a detection arrangement for a level to which the storage drum (5) is filled.

7. An apparatus according to claim 6, wherein the detection arrangement is formed by a touch contact (20) disposed on a periphery of the storage channel (7).

* * * * *